US006014932A

United States Patent [19]

Mardirossian

[11] Patent Number: 6,014,932

[45] Date of Patent: Jan. 18, 2000

[54] LAND MINE ARMING/DISARMING SYSTEM

[75] Inventor: Aris Mardirossian, Germantown, Md.

[73] Assignee: Technology Patents, LLC, Derwood, Md.

[21] Appl. No.: 08/972,394

[22] Filed: Nov. 18, 1997

[51] Int. Cl.[7] ..... F42C 7/00; F42B 22/00; B64D 1/04; G01S 13/00

[52] U.S. Cl. ..... 102/200; 102/401; 102/426; 89/1.11; 342/62

[58] Field of Search ..... 102/401, 403, 102/427, 402, 405, 416, 419, 424, 426, 200, 206, 215, 214, 217; 89/1.11, 1.13, 6.5; 342/62, 353; 244/3.14

[56] References Cited

U.S. PATENT DOCUMENTS

| | | | |
|---|---|---|---|
| 3,739,726 | 6/1973 | Pintell | 89/1.56 |
| 3,778,007 | 12/1973 | Kearney et al. | 244/3.14 |
| 3,844,215 | 10/1974 | Rogers, Jr. et al. | 102/427 |
| 4,122,775 | 10/1978 | Held . | |
| 4,174,665 | 11/1979 | Madlener . | |
| 4,506,603 | 3/1985 | Bjelvert et al. | 102/401 |
| 4,576,093 | 3/1986 | Snyder | 102/200 |
| 4,783,744 | 11/1988 | Yueh | 244/3.2 |
| 4,884,506 | 12/1989 | Guerreri | 102/200 |
| 4,979,444 | 12/1990 | Schoffl | 102/404 |
| 5,038,682 | 8/1991 | Marsden | 102/220 |
| 5,046,006 | 9/1991 | Revord et al. | 89/1.11 |
| 5,088,411 | 2/1992 | Kurokawa et al. | 102/200 |
| 5,090,321 | 2/1992 | Abouav | 102/200 |
| 5,136,949 | 8/1992 | Grosch | 102/215 |
| 5,159,149 | 10/1992 | Marsden | 102/217 |
| 5,292,254 | 3/1994 | Miller et al. | 102/427 |
| 5,371,502 | 12/1994 | Dittmann | 342/68 |
| 5,423,266 | 6/1995 | Adams | 102/401 |
| 5,476,044 | 12/1995 | Bouchek | 102/218 |
| 5,625,363 | 4/1997 | Spilker | 342/352 |
| 5,657,947 | 8/1997 | Mayersak | 244/3.19 |
| 5,661,258 | 8/1997 | Garcia et al. | 102/402 |
| 5,689,420 | 11/1997 | Brewster | 102/215 |
| 5,708,230 | 1/1998 | Woodall, Jr. et al. | 102/402 |

FOREIGN PATENT DOCUMENTS

| | | | |
|---|---|---|---|
| 4031089 | 4/1992 | Germany | 89/1.13 |
| 5149700 | 6/1993 | Japan . | |

*Primary Examiner*—Theresa M. Wesson
*Attorney, Agent, or Firm*—Joseph A. Rhoa

[57] ABSTRACT

A land mine arming/disarming system is provided in which a satellite or other airborne vehicle may remotely arm and/or disarm land mines via signals transmitted through atmospheric free space. In such a manner, land mines are less of a health hazard when conflict situations are not present.

5 Claims, 2 Drawing Sheets

LAND MINE ARMING/DISARMING SYSTEM

This invention relates to a system for remotely arming a land mine. More particularly, this invention relates to a system for remotely arming a land mine via satellite or an airborne vehicle, and corresponding method.

BACKGROUND OF THE INVENTION

Land mines are known in the art. For example, see U.S. Pat. Nos. 5,423,266; 5,371,502; 4,979,444; and 4,506,603.

Land mines are a worldwide concern in today's world. Mines installed in third world countries often go armed and undetonated for years. Then, after the conflict which necessitated the need for the mines is over, the mines remain armed in the ground thus representing a serious health hazard to citizens in the area.

In view of the above, it is apparent that there exists a need in the art for a system for remotely arming and/or disarming land mines so that after potential conflict circumstances have abated, mines can be disarmed, or vice versa. There also exists a need in the art for a system and method for positioning land mines in the earth, without arming them, so that they can be armed at a later point in time when necessary, thereby not representing a health hazard until it is necessary to arm the mines. There also exists a need in the art for a system and method for enabling a land mine to be installed in the ground when it is disarmed, and thereafter arm it for detonation so as to increase safety associated with mine installation.

SUMMARY OF THE INVENTION

Generally speaking, this invention fulfills the above-described needs in the art by providing a system for arming and disarming land mines, the system comprising:

a plurality of land mines positioned around the world;

at least one airborne vehicle including a transmitter; and the airborne vehicle including means for transmitting arming and disarming signals to the land mines in order to arm and disarm the land mines, respectively, so that when one of the land mines receives an arming signal from the transmitter the land mine arms itself so that it can be detonated with normal detonation activity, and when one of the land mines receives a disarming signal from the transmitter the land mine disarms itself when it was previously armed.

In preferred embodiments, the airborne vehicle includes one of a satellite, an airplane, and a helicopter.

This invention further fulfills the above-described needs in the art by providing a method of disarming a land mine, the method comprising the steps of:

providing a land mine in the earth;

providing a central control system and at least one satellite;

the central control system sending an instructional signal to the satellite;

the satellite, in response to receiving the instructional signal, transmitting a disarming signal to the land mine through atmospheric free space in order to disarm the mine; and the land mine receiving the disarming signal from the satellite and automatically disarming itself so that the mine cannot be detonated by normal detonation activity.

This invention also relates to arming and disarming other pieces of armament, including missiles, and the like.

This invention will now be described with certain embodiments thereof, accompanied by certain illustrations wherein.

IN THE DRAWINGS

DETAILED DESCRIPTION OF CERTAIN EMBODIMENTS OF THIS INVENTION

Figure 1:
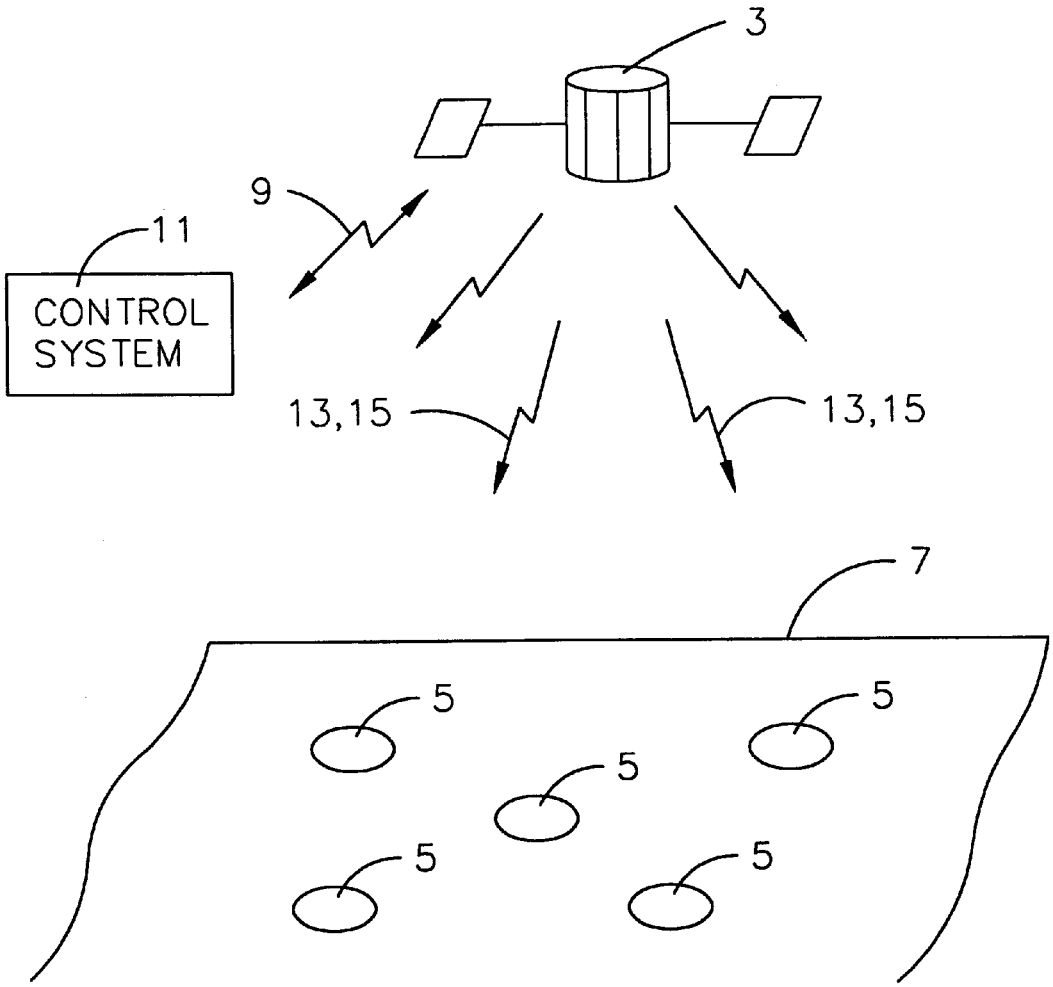
FIG. 1 is a schematic diagram illustrating a satellite for use in arming land mines and in accordance with an embodiment of this invention.

Referring now more particularly to the accompanying drawings in which like reference numerals indicate like parts throughout the several views.

FIG. 1 illustrates an embodiment of this invention wherein satellite 3 (or any other airborne vehicle such as an airplane, helicopter, or the like) includes a transmitter for emitting arming signals 13 to land mines 5 embedded within ground 7 for the purpose of arming the land mines. Furthermore, satellite 3 may also send disarming signals 15 to land mines 5 in order to disarm the land mines. When mines 5 are disarmed, they are switched into an inactive state so that they cannot be detonated if stepped on or the like (normal detonation occurrences will not detonate the mine(s)). For example, so that mines 5 may be more safely and quickly installed in the ground, mines 5 according to this invention may be installed when they are disarmed so that they cannot detonate, and after they are installed they can be armed by satellite signal 13 (this is a safety and efficiency precaution).

Accordingly, land mines 5 may be embedded within the ground 7 in an unarmed manner so that if they are stepped on or the like, they do not detonate. In such a manner, land mines may be positioned in areas without actual conflict, without arming the land mines. Thereafter, should a conflict situation arise, satellite 3 may be instructed 9 by central control system 11 to send arming signals 13 to certain land mines at a particular location(s). When a land mine 5 receives an arming signal 13, the land mine switches from an unarmed state to an "armed" state. When armed, when a land mine 5 is stepped on otherwise activated, the mine will detonate. However, when a land mine 5 is not armed, a normal detonation occurrence cannot cause it to detonate.

Still further, when potential conflict situations dissipate and no longer exist, land mines 5 that have previously been armed in ground 7 can be disarmed by satellite 3 sending disarming signals 15 to the land mines. When a mine 5 receives a disarming signal 15 from satellite 3 or any other airborne vehicle, the mine switches from an armed state to an unarmed state.

Figure 2:
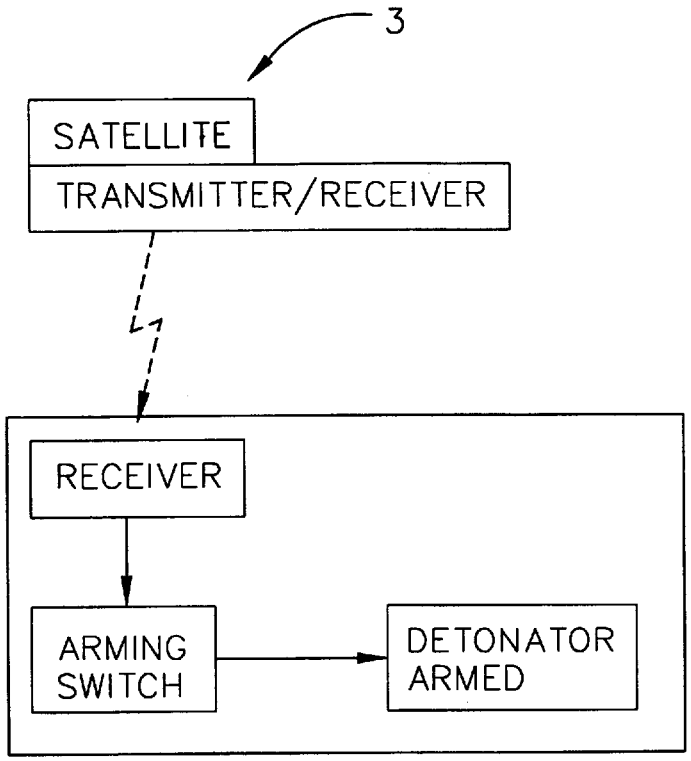
FIG. 2 is a block diagram illustrating a satellite and corresponding land mine in accordance with the FIG. 1 embodiment of this invention.

FIG. 2 is a block diagram illustrating satellite 3 which includes a transmitter portion and a receiver portion. The receiver of satellite 3 receives control signals 9 from central control system 11 which instruct satellite 3 whether to send arming or disarming signals to land mines in a particular area of the globe. For example, control system 11 may instruct satellite 3 via instructional control signals 9 to arm land mines 5 in a particular sector of the world. The receiver of satellite 3 receives this instructional signal(s), and in response thereto causes satellite 3 to emit arming signals 13 to land mines 5 in that particular area of the world in order to arm same. Thereafter, should it be desirable to disarm these land mines, control system 11 sends an instructional signal 9 to satellite 3 instructing the satellite to disarm particular land mines 5. The receiver of the satellite receives signal(s) 9 and causes satellite 3 to transmit disarming signals 15 to the previously armed land mines 5 in order to disarm same. After land mines 5 have been disarmed, they no longer can be normally detonated by civilians or the like.

In certain embodiments, mines 5 can be equipped with a transmitter for transmitting status signals to satellites or any other airborne vehicles, for indicating whether (i) the mine is armed, (ii) the mine is disarmed, or (iii) indicating that the mine has not been detonated. Thus, when satellites 3 do not receive status signal(s) from a particular mine, it can be assumed (it is indicated) that mine 5 has been detonated and not longer has to be considered or monitored. These status signals can also be used to determine by control system 11 the status of different mines 5.

In certain further embodiments, after a satellite or other airborne vehicle sends an arming or disarming signal(s) to a particular land mine 5 through atmospheric free space, that mine may in response thereto transmit a confirmation signal back to the satellite so that the satellite and central control system are informed that the mine has received the arming/disarming signal and that thus the mine status should have been changed. Thus, if no confirmation tone/signal is received by the satellite after sending an arming/disarming signal, this may be an indication that the mine has been detected by the enemy and/or detonated previously.

Figure 3:
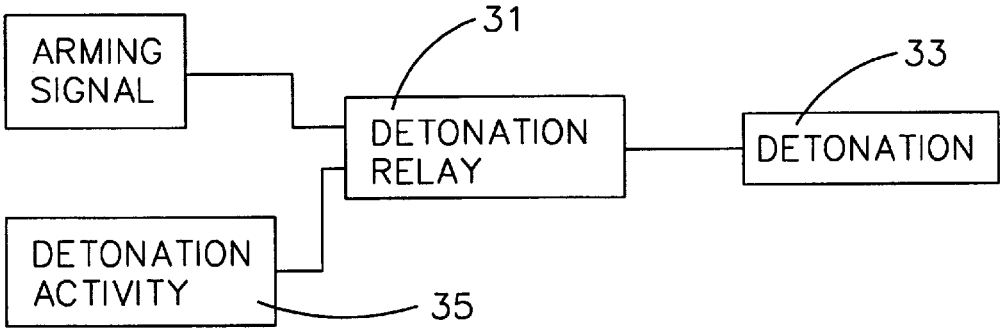
FIG. 3 is a block diagram/flow chart illustrating a detonation relay according to an embodiment of this invention in the mine.

FIG. 3 illustrates one embodiment of this invention as to how a mine 5 can be detonated. Mine 5 can be provided with detonation relay 31. Relay 31 only allows mine 5 to detonate 33 when two things occur, namely (i) mine 5 is armed by having received an arming signal 13 from an airborne vehicle, and (ii) detonation activity 35 is detected. If relay 31 should receive logic indicative of one or the other, there is no detonation 33. However, when an arming signal has previously been received, and when detonation activity (e.g. a pressure switch is activated) is detected, then the mine detonates 33.

In alternative embodiments of this invention, satellite 3 may be used to arm and/or disarm armament(s) other than land mines. For example, this invention may be used to arm/disarm missiles, rifles, and the like. Thus, in a missile embodiment, the missile could be sold to a foreign country in a disarmed state, and only later be armed by satellite 3 after the satellite sends arming signal(s) to the missile. Also, missiles sold to foreign countries that later become hostile to the U.S., could be disarmed by satellite 3 so that they could not be used against this country.

Once given the above disclosure, many other features, modifications, and improvements will become apparent to the skilled artisan. Such other features, modifications, and improvements are therefore considered to be a part of this invention, the scope of which is to be determined by the following claims.

I claim:

1. A method of disarming a land mine, the method comprising the steps of:

providing a land mine in the earth;

providing a central control system and at least one satellite;

the central control system sending an instructional signal to the satellite;

the satellite, in response to receiving the instructional signal, transmitting a disarming signal to the land mine through atmospheric free space in order to disarm the mine;

the land mine receiving the disarming signal from the satellite and automatically disarming itself so that the mine cannot be detonated if stepped;

the land mine transmitting a confirmation signal to the satellite in response to receiving the disarming signal so as to indicate via the satellite that the disarming signal has been received; and the land mine on a substantially continuous or periodic basis transmitting status signals through atmospheric free space to the satellite in order to indicate via the satellite the status of the land mine.

2. The method of claim 1, wherein the land mine cannot be detonated unless it is in an armed state.

3. The method of claim 1, wherein the land mine includes a receiver circuit, a disarming switch, and a detonator which may be armed and disarmed, so that when the land mine receives a disarming signal from the satellite the receiver of the land mine receives the disarming signal and the switch in the land mine disarms the mine.

4. A system for arming and disarming land mines, the system comprising:

a plurality of land mines;

at least one airborne vehicle;

the airborne vehicle including means for transmitting arming and disarming signals to said land mines in order to arm and disarm the land mines, respectively, so that when one of said land mines receives an arming signal from said transmitter said land mine arms itself so that it can be detonated when stepped on, and when one of said land mines receives a disarming signal from said transmitter said land mine disarms itself when it was previously armed;

each of said land mines including a relay which permits detonation of the mine only when (i) an arming signal has previously been received by the mine, and (ii) detonation activity is detected by the mine;

each land mine including means for transmitting a confirmation signal in response to receiving the disarming signal so as to indicate that the disarming signal has been received; and each land mine including means for transmitting on a substantially continuous or periodic basis status signals through atmospheric free space in order to indicate the status of the land mine.

5. The system of claim of 4, wherein said airborne vehicle includes one of a satellite, an airplane, and a helicopter.

* * * * *